US006148994A

United States Patent [19]

Olsen

[11] Patent Number: 6,148,994

[45] **Date of Patent: *Nov. 21, 2000**

[54] LARGE LABEL PANEL CONTAINER CARRIER

[75] Inventor: Robert Olsen, Medinah, Ill.

[73] Assignee: Illinois Tool Works Inc., Glenview, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/173,118

[22] Filed: Oct. 15, 1998

[51] Int. Cl.[7] ..... B65D 75/00

[52] U.S. Cl. ..... 206/150; 206/427; 294/87.2

[58] Field of Search ..... 206/147, 150, 206/151, 156, 158, 427; 294/87.2

[56] References Cited

U.S. PATENT DOCUMENTS

| | | |
|---|---|---|
| 3,038,602 | 6/1962 | Rapata . |
| 3,085,682 | 4/1963 | Poupitch . |
| 3,156,358 | 11/1964 | Randrup . |
| 3,734,278 | 5/1973 | Kerrigan et al. . |
| 4,018,331 | 4/1977 | Klygis . |
| 4,269,308 | 5/1981 | Platt . |
| 4,385,691 | 5/1983 | Klygis . |
| 4,487,312 | 12/1984 | Heider . |
| 4,518,081 | 5/1985 | de Larosiere . |
| 5,018,620 | 5/1991 | Marco et al. . |
| 5,038,928 | 8/1991 | Marco et al. . |
| 5,072,829 | 12/1991 | Marco et al. . |
| 5,682,983 | 11/1997 | Weaver et al. . |

FOREIGN PATENT DOCUMENTS

| | | |
|---|---|---|
| 507 479 | 7/1995 | European Pat. Off. . |
| 838 408 | 4/1998 | European Pat. Off. . |

*Primary Examiner*—Paul T. Sewell
*Assistant Examiner*—Nhan T. Lam
*Attorney, Agent, or Firm*—Pauley Petersen Kinne & Fejer

[57] ABSTRACT

This invention relates to a package of a plurality of containers unitized with a flexible carrier. The carrier is constructed from a plastic planar sheet having a plurality of container receiving openings including corner container receiving openings and inner container receiving openings. A panel is positioned with respect to a straight longitudinal panel edge of the container receiving openings. When the containers are inserted into the container receiving openings, the panel remains flat and tight with respect to the containers. The panel is urged into a flat position with respect to the containers through a distinct spatial relationship between and among the container receiving openings.

13 Claims, 3 Drawing Sheets

LARGE LABEL PANEL CONTAINER CARRIER

BACKGROUND OF THE INVENTION

1. Field of the Invention

This invention relates to a carrier, for unitizing a plurality of containers, having a plurality of container receiving openings configured to allow an integral panel to remain in a flat and tight position with respect to the containers.

2. Description of Prior Art

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, when used alone has little or no advertising or promotional printing space. Conversely, the box carrier generally has a relatively large amount of area for promotional graphics. Disadvantageously, the box carrier requires a relatively large amount of material, permits bottles to fall out if it is not maintained in an upright position, and usually shrouds much of the actual containers. Therefore, there is a need for a package that incorporates the stability and economy of a ring carrier and the promotional area of a box carrier.

SUMMARY OF THE INVENTION

It is one object of this invention to provide a container carrier that unitizes a plurality of containers into a tight, solid package.

It is another object of this invention to provide a container carrier that provides a panel for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is still another object of this invention to provide a container carrier that maintains a panel in a flat and tight configuration with respect to the unitized containers.

A carrier according to this invention carries a plurality of containers such as cans. The carrier comprises a planar, preferably plastic, sheet formed with a plurality of container receiving openings. The container receiving openings are formed in longitudinal rows and transverse ranks.

The container receiving openings preferably include a plurality of corner container receiving openings and a plurality of inner container receiving openings. The corner container receiving openings are preferably located at each of four corners of the sheet and have a first longitudinal length and a first radius. The inner container receiving openings are preferably located in inner ranks of the transverse ranks and have a second longitudinal length and at least one corner with a second radius. Preferably, the first longitudinal length is different in length from the second longitudinal length and the first radius is greater than the second radius.

A panel is integrally formed with the sheet so that the panel extends outward from a panel edge of the sheet. The panel edge is at least partially formed in a generally straight line along at least a portion of each container receiving opening that is adjacent to the panel.

A first longitudinal band is also formed between transversely adjacent corner container receiving openings while a second longitudinal band is formed between transversely adjacent inner container receiving openings. The first longitudinal band is narrower than the second longitudinal band.

In addition to the above features, the carrier may also include an integral handle, an end web, a flap in the corner container receiving openings and a line of perforation formed within the carrier. Such features as described above result in a carrier configured to carry a plurality of containers.

The containers are positioned in each container receiving opening to form a package having a panel that is flat, tight and parallel with respect to the containers and prominent with respect to the package. Such a configuration of the panel results in a package of containers having a prominent display area or "billboard" for advertising, information, graphics and other marketing material.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
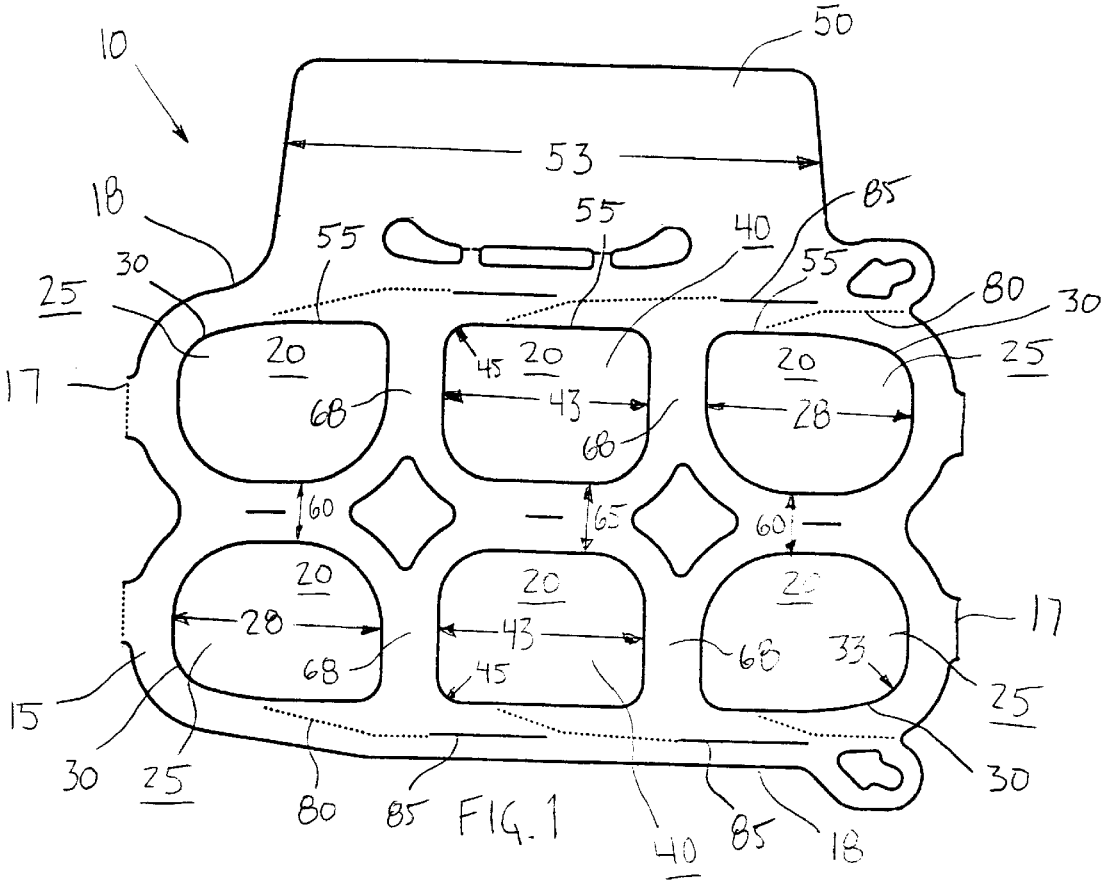
FIG. 1 is a top view of a carrier for holding six containers according to one preferred embodiment of this invention.
Figure 2:
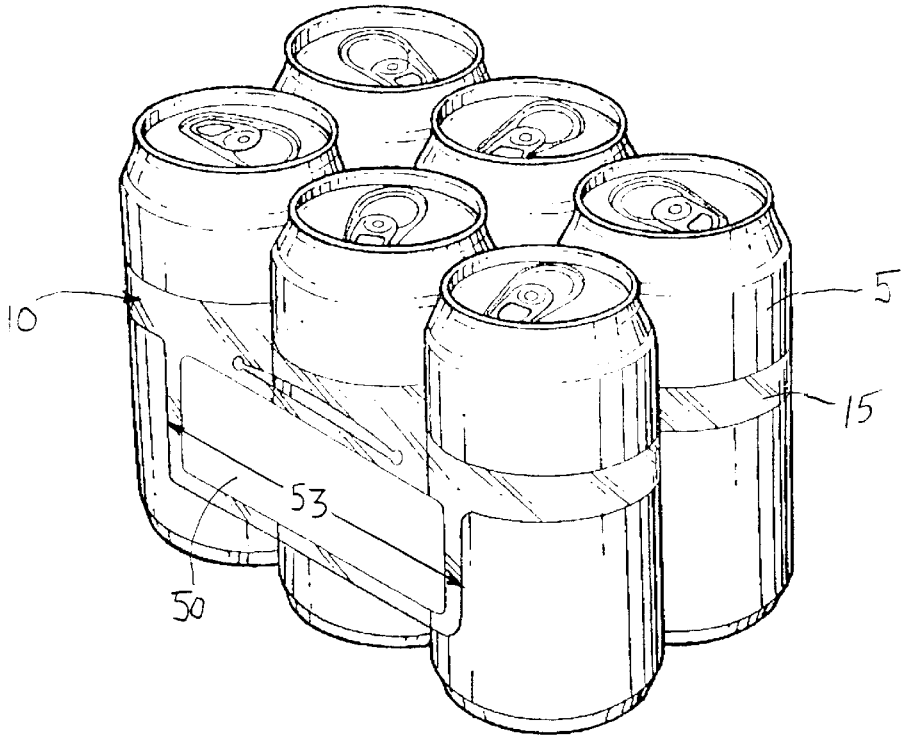
FIG. 2 is a perspective view of a package of containers using a carrier according to one preferred embodiment of this invention.

FIGS. 1–5 show carrier 10 for carrying a plurality of containers 5. Containers 5 shown in FIG. 2 are preferably cans. Although cans are shown in FIG. 2, bottles or any other commonly unitized container 5 may be used with carrier 10 according to this invention. Containers 5 are preferably like-sized within a single carrier 10.

Carrier 10 unitizes a plurality of containers 5 to create package 1, such as package 1 shown in FIG. 2. Carrier 10 comprises planar sheet 15 preferably constructed from a flexible, resilient material such as plastic. In one preferred embodiment of this invention, sheet 15 is made from low density polyethylene. Sheet 15 preferably comprises two transverse edges 17 and two longitudinal edges 18.

Sheet 15 of material is preferably cut, using means known to those skilled in the art, such as a stamping die, to form a plurality of container receiving openings 20 in sheet 15. Preferably, six or more container receiving openings 20 are formed in sheet 15 in longitudinal rows and transverse ranks. Preferably, container receiving openings 20 are configured in two rows of three ranks or in two rows of four ranks. Sheet 15 may include other configurations of container receiving openings 20 depending on the size of package 1 desired.

Container receiving openings 20 preferably comprise a plurality of corner container receiving openings 25 and a plurality of inner container receiving openings 40. Container receiving openings 20 are preferably longer in a longitudinal direction than wide in a transverse direction.

Corner container receiving openings 25 are located at an intersection between an outermost row of the longitudinal rows and an outermost rank of the transverse ranks. Each carrier 10 includes four corner container receiving openings located at each of four corners of sheet 15. Corner container receiving openings 25 have a first longitudinal length 28. Corner container receiving opening 25 also includes outer corner 30 having first radius 33.

Inner container receiving openings 40 are located in an inner rank of the transverse ranks. Depending upon the capacity of carrier 10, sheet 15 preferably includes two or more inner container receiving openings 40. Inner container receiving openings 20 have a second longitudinal length 43. Inner container receiving openings 40 also include at least one corner, and preferably two corners, with second radius 45.

According to one preferred embodiment of this invention, first radius 33 is greater than second radius 45. Specifically, first radius 33 is preferably approximately ¾" or greater and second radius 45 is preferably approximately ¼".

In one preferred embodiment of this invention, panel 50 is integrally formed with sheet 15. Panel 50 preferably has an overall longitudinal panel length less than an overall length of longitudinal edge 18. Panel 50 preferably accommodates, on one or both sides, UPC and proof of purchase labels, graphics, and promotional and/or other information related to contents and/or ingredients of package 1. Panel 50 is preferably generally continuous and unbroken, without cutouts or apertures, throughout its defined area.

Panel 50 preferably extends outward from longitudinal edge 18 of sheet 15. Specifically, panel 50 preferably extends outward from panel edge 55 of sheet 15. As shown in FIGS. 1 and 3–5, panel edge 55 is at least partially formed along a portion of each container receiving opening 20 that is adjacent to panel 50. Panel edge 55 is preferably positioned in a longitudinal direction along a generally straight line. The generally straight line of panel edge 55 is formed to correspond to longitudinal length 53 of panel 50.

First longitudinal band 60 is preferably formed between transversely adjacent corner container receiving openings 25. Second longitudinal band 65 is preferably formed between inner container receiving openings 40. In addition, transverse bands 68 are formed between each longitudinally adjacent container receiving opening 20. According to one preferred embodiment of this invention, first longitudinal band 60 is narrower than second longitudinal band 65.

Figure 4:
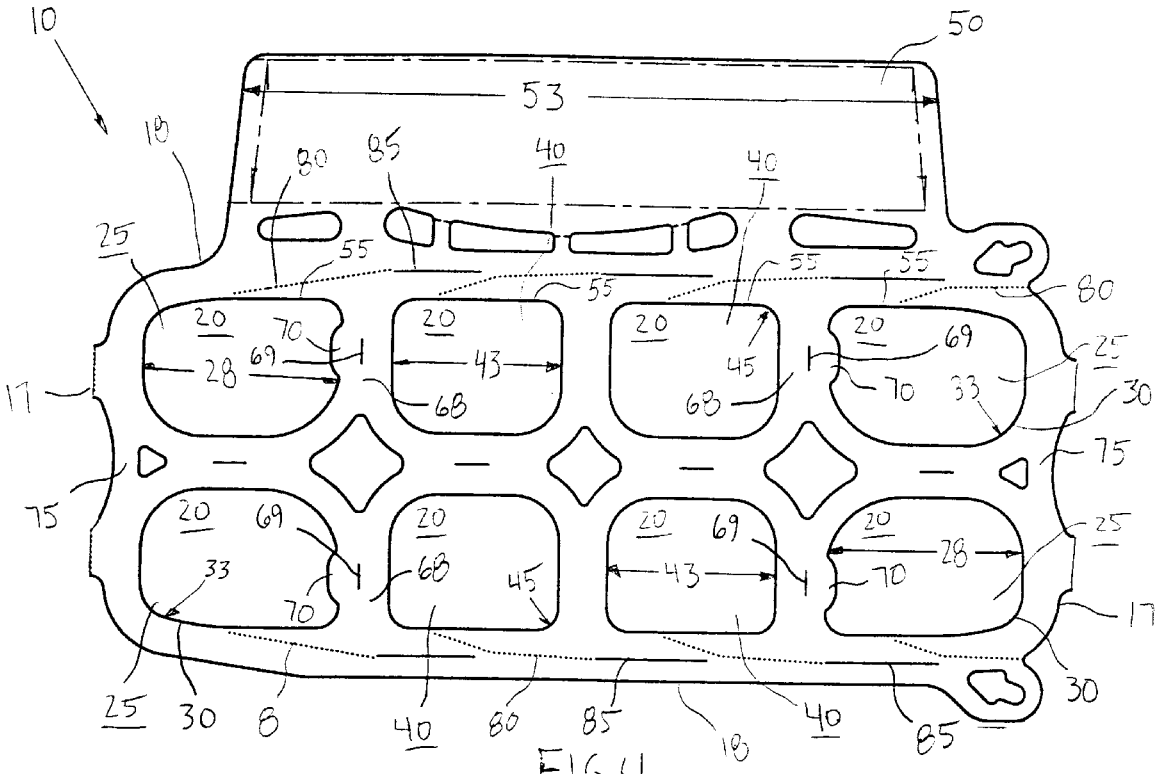
FIG. 4 is a top view of a carrier for holding eight containers according to one preferred embodiment of this invention.

In one preferred embodiment of this invention, shown in FIG. 4, carrier 10 further comprises end web 75 positioned at each of two transverse edges 17 of sheet 15. End web 75 preferably comprises a band of material extending between corner container receiving openings 25 along transverse edges 17 of sheet 15.

Figure 3:
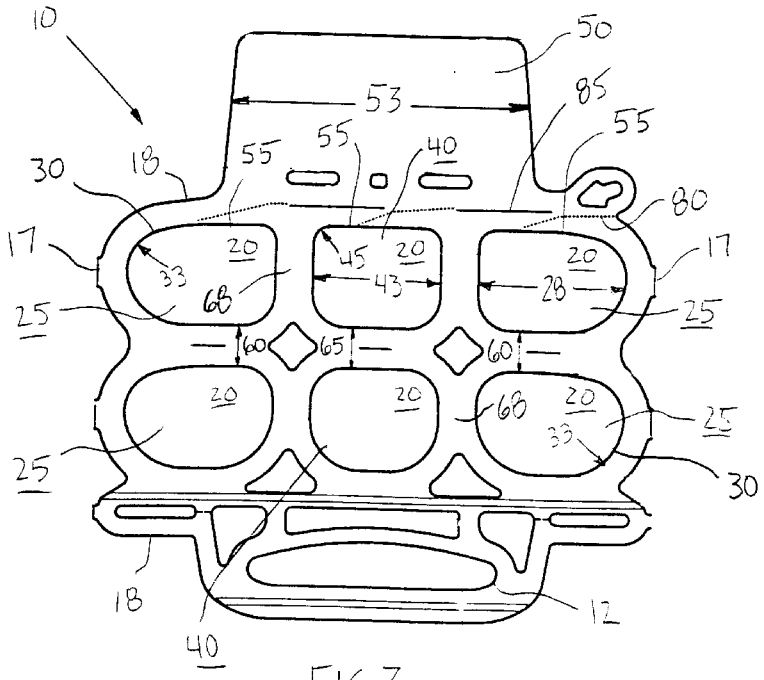
FIG. 3 is a top view of a carrier for holding six containers according to another preferred embodiment of this invention.

As shown in FIGS. 1–3, in one preferred embodiment of this invention, carrier 10 comprises sheet 15 having six container receiving openings 20. In this preferred embodiment, first longitudinal length 28 of corner container receiving opening 25 is preferably greater than second longitudinal length 43 of inner container receiving opening 40. In alternative embodiments of this invention, first longitudinal length 28 of corner container receiving opening 25 is approximately equal to second longitudinal length 43 of inner container receiving opening 40.

Figure 5:
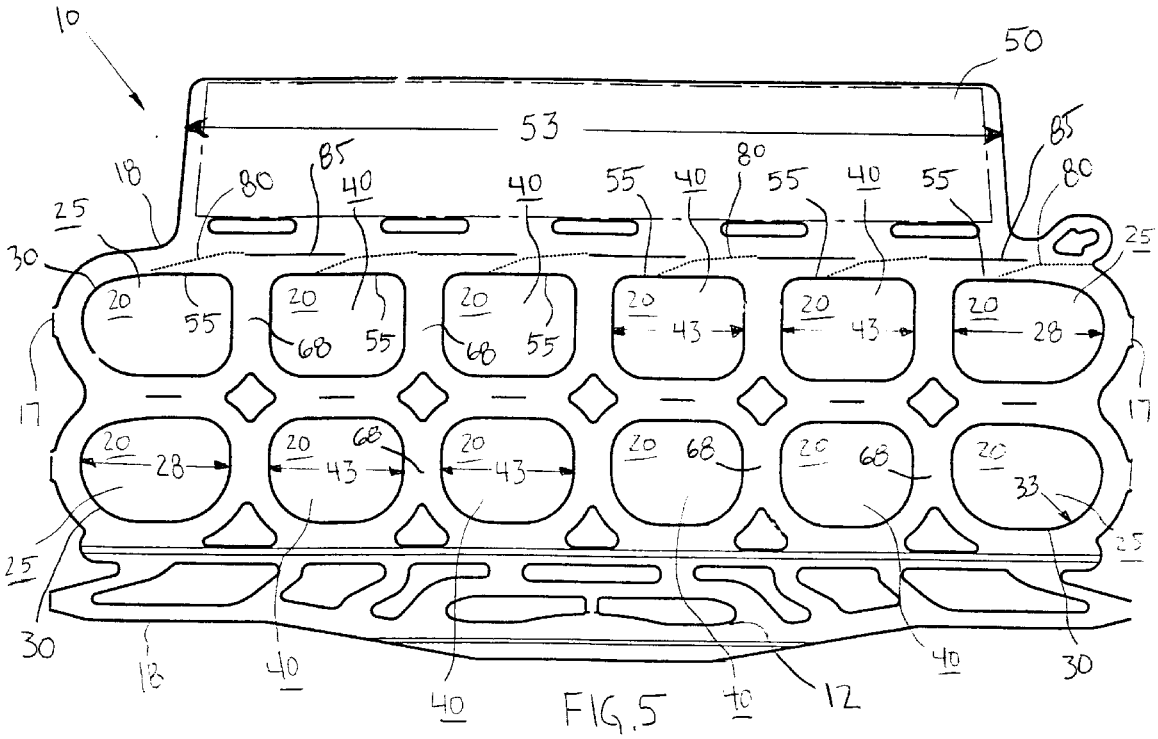
FIG. 5 is a top view of a carrier for holding twelve containers according to another preferred embodiment of this invention.

As shown in FIGS. 4 and 5, carrier 10 comprises sheet 15 having eight or more container receiving openings 20. In this preferred embodiment, second longitudinal length 43 is preferably greater than the first longitudinal length 28. In one preferred embodiment of this invention, second longitudinal length 43 is approximately 8% larger than first longitudinal length 28.

In a preferred embodiment of this invention shown in FIGS. 3 and 5, carrier 10 further comprises integral handle 12 positioned along an opposite longitudinal edge 18 as panel edge 55 of sheet 15. Handle 12 is particularly important in configurations of carrier 10 that contain many container receiving openings 20 to facilitate ease of handling of package 1.

As shown in FIG. 2, container 5 is positioned in each container receiving opening 20 to form package 1. Panel 50 is preferably flat and parallel with respect to containers 5 and prominent with respect to package 1. If panel 50 is curled or folded in a perpendicular position with respect to package 1, then advertising or other material positioned on panel will not be legible to a consumer. In addition, a panel 50 that protrudes with respect to package 1 will create difficulties in packaging, handling and stacking packages 1 because of interference between panels 50 of adjacent packages 1 and between panel 50 and packaging equipment.

Several of the above described features of carrier 10 facilitate a flat and prominent panel 50 with respect to package 1. For example, the generally straight line formed by panel edge 55 urges panel 50 into a generally flat position with respect to containers 5 in package 1. In addition, the relative difference between first longitudinal length 28 of corner container receiving openings 25 and second longitudinal length 43 of inner container receiving openings 40, thereby creating an irregular longitudinal pitch between container receiving openings 20, also aids in the relative flatness of panel 50 with respect to package 1.

The relative difference in width between first longitudinal band 60 and second longitudinal band 65 also creates a tighter unitized block of containers 5 within package 1, specifically at transverse edges 17 where panel 50 is most likely to curl. The result of a tight unitized block of containers 5 is a flat panel 50 with respect to package 1.

In one preferred embodiment of this invention, shown in FIG. 4, sheet 15 further comprises flap 70 positioned in transverse band 68 adjacent one or more corner container receiving opening 25. Flap 70 is preferably positioned along one transverse band 68 adjacent corner container receiving opening 25. Flap 70 functions as a shim between container 5 and corner container receiving openings 25 thereby allowing transverse band 68 to fold at band slit 69 which further urges panel 50 into a flat position.

According to one preferred embodiment shown in FIGS. 1 and 3–5, carrier 10 further comprises at least one line of perforation 80 adjacent container receiving opening 20. Lines of perforation 80, preferably in combination with removal slits 85, are preferably positioned from an external edge of sheet 15, such as transverse edge 17, to an edge of container receiving opening 20. Therefore, when line of perforation 80 is separated, container 5 is more easily removable from carrier 10.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A carrier for carrying a plurality of containers, the carrier comprising:

a planar sheet of a plastic material, the sheet having a plurality of container receiving openings arranged in longitudinal rows and transverse ranks;

a corner container receiving opening of the container receiving openings located at an intersection between an outermost row of the longitudinal rows and an outermost rank of the transverse ranks, the corner container receiving opening having a first longitudinal length defined along a greatest longitudinal axis and having an outer corner in the form of a first arc having a first degree of curve;

a first longitudinal band between the corner container receiving openings;

an inner container receiving opening of the container receiving openings located in an inner rank of the transverse ranks, the inner container receiving opening having a second longitudinal length defined along a greatest longitudinal axis, the second longitudinal length shorter than the first longitudinal length and having at least one corner in the form of a second arc having a second degree of curve, the first degree of curve being greater than the second degree of curve;

a second longitudinal band between the inner container receiving openings, the second longitudinal band wider than the first longitudinal band;

a panel integrally formed with the sheet, the panel extending outward from a panel edge of the sheet and formed to lay flat with respect to the plurality of containers; and the panel edge at least partially formed along a portion of each of the container receiving openings, the panel edge positioned in a longitudinal direction along a generally straight line.

2. The carrier of claim 1 wherein the sheet further comprises a flap positioned in the corner container receiving opening.

3. The carrier of claim 1 wherein a longitudinal panel length is less than a longitudinal sheet length.

4. The carrier of claim 1 further comprising an end web positioned at each of two transverse edges of the sheet.

5. The carrier of claim 1 wherein the sheet has six container receiving openings.

6. The carrier of claim 5 wherein the first longitudinal length is greater than the second longitudinal length.

7. The carrier of claim 1 wherein the sheet has eight container receiving openings.

8. The carrier of claim 7 wherein the second longitudinal length is greater than the first longitudinal length.

9. The carrier of claim 1 further comprising a line of perforations adjacent the container receiving openings.

10. The carrier of claim 1 further comprising an integral handle positioned along an opposite edge from the panel edge of the sheet.

11. A carrier for carrying a plurality of containers in a package comprising:

a planar sheet of a plastic material, the sheet having a plurality of container receiving openings arranged in longitudinal rows and transverse ranks each container receiving opening engaging a container of the plurality of containers;

a corner container receiving opening of the container receiving openings located at an intersection between an outermost row of the longitudinal rows and an outermost rank of the transverse ranks, the corner container receiving opening having a first longitudinal length defined along a greatest longitudinal axis and an outer corner in the form of a first arc having a first degree of curve;

a first longitudinal band between corner container receiving openings;

an inner container receiving opening of the container receiving openings located in an inner rank of the transverse ranks, the inner container receiving opening having a second longitudinal length defined along a greatest longitudinal axis and at least one corner in the form of a second arc having a second degree of curve, wherein the first degree of curve is larger than the second degree of curve and the first longitudinal length is greater than the second longitudinal length;

a second longitudinal band between inner container receiving openings, the second longitudinal band wider than the first longitudinal band;

the sheet having an integral panel extending outwardly from a panel edge of the sheet and flat and smooth with respect to a side of the package, the integral panel having an overall longitudinal panel length less than an overall longitudinal sheet length; and the panel edge at least partially formed along a portion of each of the container receiving openings, the panel edge positioned in a longitudinal direction, along a generally straight line.

12. The carrier of claim 11 wherein the sheet further comprises a flap positioned in the corner container receiving opening.

13. The carrier of claim 11 further comprising an end web positioned at each of two transverse edges of the sheet.

* * * * *